US006140564A

United States Patent [19]

Pia

[11] Patent Number: 6,140,564

[45] Date of Patent: Oct. 31, 2000

[54] GUITAR PIC RETAINER CLIP

[76] Inventor: Richard A. Pia, 1525 Victoria Chase, Cumming, Ga. 30041

[21] Appl. No.: 09/443,415

[22] Filed: Nov. 19, 1999

[51] Int. Cl.[7] ..... G10G 7/00

[52] U.S. Cl. ..... 84/453; 84/322; 84/329; 84/320; 84/321

[58] Field of Search ..... 84/453, 320, 321, 84/322, 329

[56] References Cited

U.S. PATENT DOCUMENTS 5,739,445 4/1998 Terry et al. ..... 84/329

*Primary Examiner*—David Martin
*Assistant Examiner*—Shih-yung Hsieh
*Attorney, Agent, or Firm*—William B. Noll

[57] ABSTRACT

A semi-rigid, plastic retainer clip for temporarily receiving and gripping a plurality of guitar pics. The retainer clip is U-shaped and includes a pair of L-shaped clip members for removably securing the retainer clip to the supporting strap of the guitar. This conveniently positions the pics for the guitar player.

9 Claims, 2 Drawing Sheets

GUITAR PIC RETAINER CLIP

FIELD OF THE INVENTION

This invention is directed to the field of guitar accessories, more particularly to a retainer clip for receiving and conveniently but removably securing plural guitar pics.

BACKGROUND OF THE INVENTION

The present invention relates to a convenient and inexpensive means for temporarily storing plural guitar pics, where said means may be removably secured to the guitar holding strap. Guitar pics, as known in the art, typically comprise a planar plastic member that is generally triangular in shape, but having rounded corner. The pic is gripped by the guitar player between the thumb and adjacent finger and struck against the respective guitar strings. The pics are generally plastic and may have a thickness of between about 0.5 mm to about 2 mm, and in fact a plurality of such pics are often desired by the guitar player. Absent a convenient means to secure the several pics, the guitar player must often place the pics in a pocket and search for same when needed.

The present invention offers a convenient and inexpensive means to temporarily store plural pics, of varying thicknesses, at the ready finger tips of the guitar player. The manner by which the present invention achieves this convenience will become readily apparent to those skilled in the art from the following description when read in conjunction with the accompanying drawings.

SUMMARY OF THE INVENTION

This invention is directed to a semi-rigid retainer clip, preferably fabricated from polycarbonate plastic, for removably gripping a plurality of planar guitar pics. The retainer clip is adapted to be mounted to a guitar strap for convenient access thereto by the user thereof. The retainer clip comprises a generally U-shaped body having first and second free legs, each with a free end, converging toward one another, where the respective free ends define a slot of a thickness, in the resiled condition, less than the guitar pics. Extending rearwardly from the first leg are plural reversely bent L-shaped clip members extending from the free end of the first leg.

Accordingly, an object of this invention is to provide an inexpensive guitar retainer clip that may be worn by the guitar player for easy access to the several pics contained therein.

Another object hereof is the provision of a unitary retainer clip that can easily grip and temporarily retain plural guitar pics of varying thicknesses.

These and other objects of the invention will become clearer from the specification which follows.

DETAILED DESCRIPTION OF PREFERRED EMBODIMENT

Figure 1:
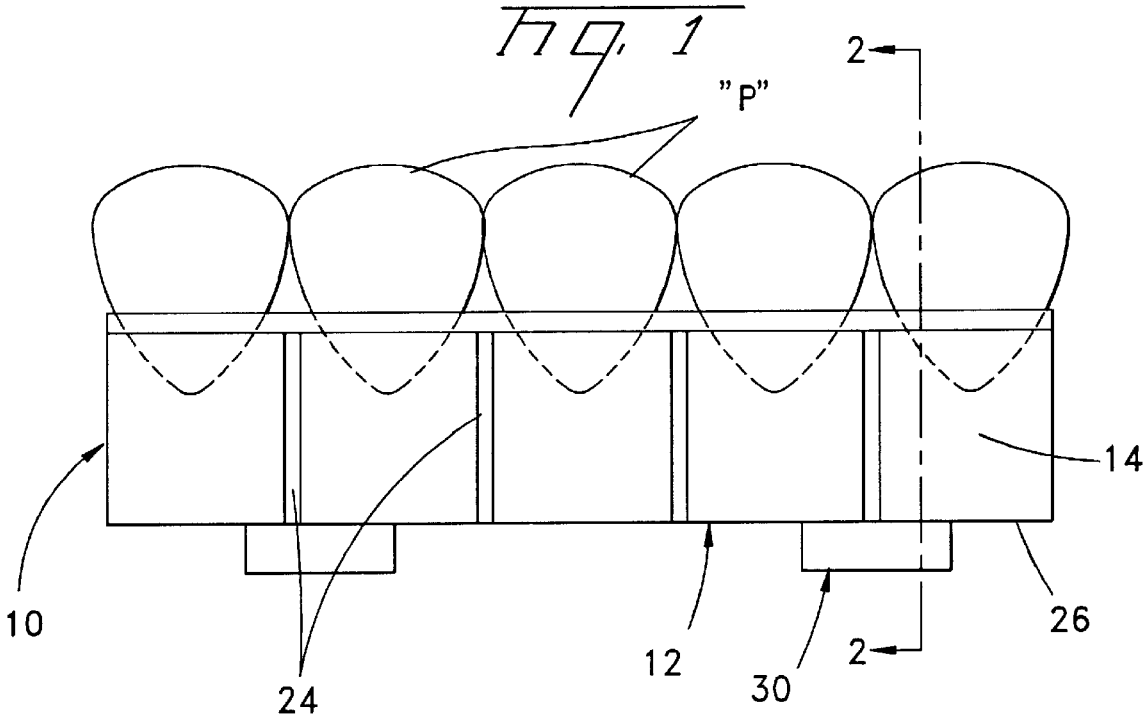
FIG. 1 is a front view of the guitar pic retainer clip according to the present invention, further showing plural guitar pics temporarily positioned therein.

The present invention relates to a retainer clip, adapted to be worn at a convenient place on the user, to grippingly receive a plurality of guitar pics. The retainer clip will now be described with regard to the three Figures, where like reference numerals represent like components or features throughout the several views.

Figure 2:
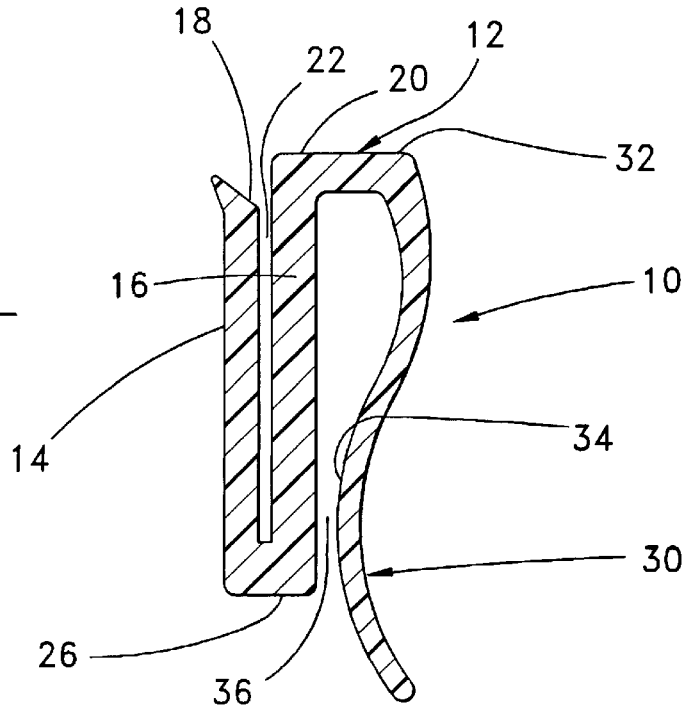
FIG. 2 is a sectional view, less the guitar pics, taken along line 2—2 of FIG. 1.

Turning now to FIGS. 1 and 2, illustrating, respectively, a front view and sectional view of the retainer clip 10 of this invention. The retainer clip 10, preferably formed of a semi-rigid plastic, such as polycarbonate, comprises an elongated U-shaped channel member 12. The channel member 12 consists of first and second legs 14, 16, respectively, each having a free or top edge 18, 20, respectively. The respective top edges 18, 20 define a longitudinal slot 22 having an opening between such top edges of a first dimension, the significance of which will become apparent hereafter.

To enhance the flexible nature of the U-shaped channel member 10 to accommodate plural guitar pics "P", see FIG. 1, the first leg 14 is provided with plural slots 24, extending from the top edge 18 to the base 26, to define plural segments equal in number to the pics "P" to be received therein. Since a typical set of guitar pics may vary in thickness between about 0.5 mm to 2 mm, and said first dimension is less than the thinnest guitar pic "P", the channel member legs can selectively flex to grippingly receive the set of guitar pics, irrespective of thickness.

Figure 3:
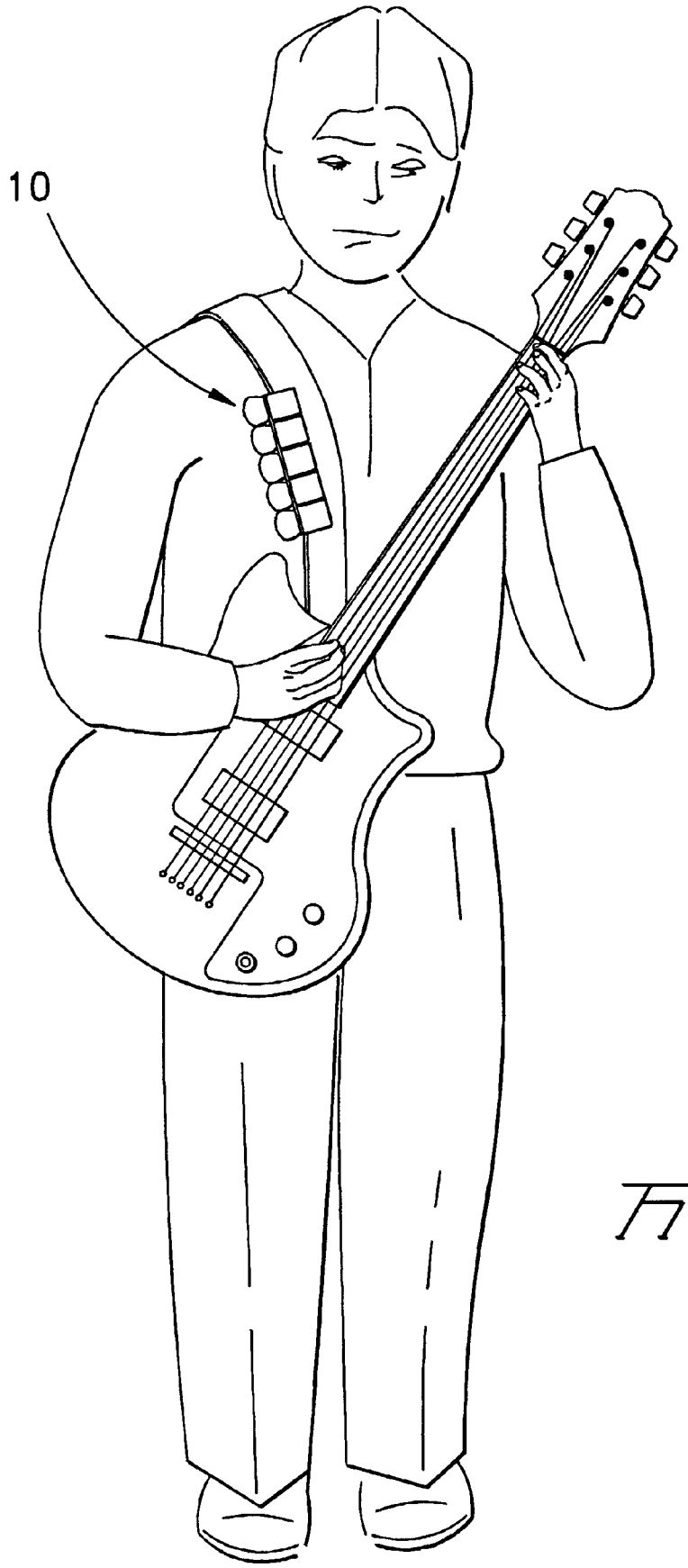
FIG. 3 is a front view illustrating the convenient manner for mounting the retainer clip of this invention to a wearer's guitar strap.

To temporarily secure the retainer clip 10 for easy access to the guitar pics by the user, i.e. guitar player, such as on the supporting guitar strap, see FIG. 3, the retainer clip 10 is provided with plural clip members 30. Said members, preferably two in number, each comprise an L-shaped member consisting of a first leg 32 integrally formed to the top edge 20 of the said second leg 16. The second leg of the L-shaped member is preferably sinusoidal in configuration and lies in close proximity to the rear face of second leg 16. By this arrangement, coupled with the inwardly directed curved portion 34 of said second leg, 32, a narrow gap 36 is formed to receive the guitar strap or similar article. That is, the retainer clip 10 may be easily placed on and retained by the guitar strap, for example, providing easy access to the guitar player.

It is recognized that variations, changes and modifications may be made to the retainer clip of this invention, especially by those skilled in the art. Accordingly, no limitation is intended to be imposed thereon except as set forth in the accompanying claims.

What is claimed is:

1. A semi-rigid retainer clip for removably securing a plurality of planar guitar pics, where said retainer clip is adapted to be mounted to a guitar strap for convenient access thereto by the user thereof, said retainer clip comprising:

a.) a generally U-shaped body having first and second free legs, each with a free end, converging toward one another, where said free ends define a slot of a first thickness; and b.) plural reversely bent L-shaped clip members extending from the free end of said first free leg away from said slot.

2. The retainer clip according to claim 1, wherein there are two spaced apart L-shaped clip members.

3. The retainer clip according to claim 1, where said guitar pics have a thickness greater than said first thickness.

4. The retainer clip according to claim 3, wherein each said guitar pic has a thickness between about 0.5 mm to 2 mm.

5. The retainer clip according to claim 1, wherein said L-shaped clip member has a first leg secured to the free end of said first leg, and a second sinusoidal-shaped leg, where said sinusoidal-shaped leg and said first free leg cooperatively receive said guitar strap to removably secure said retainer clip thereto.

6. The retainer clip according to claim 5, wherein said sinusoidal-shaped leg is of a length greater than said first free leg.

7. The retainer clip according to claim 4, wherein said second free leg includes plural slots extending away from its corresponding free end to define plural leg segments, where each segment is of a size to accommodate one said guitar pic.

8. The retainer clip according to claim 7, wherein said plural slots are parallel to one another, and generally perpendicular to said corresponding free end.

9. The retainer clip according to claim 1, wherein said retainer clip is manufactured of a polycarbonate plastic.

* * * * *